US005956993A

United States Patent [19]

Akamatsu

[11] Patent Number: 5,956,993

[45] Date of Patent: Sep. 28, 1999

[54] FORGING OR COLD-PRESSING TOOL AND METHOD OF ASSEMBLING SAME

[75] Inventor: Ken-ichi Akamatsu, Hirakata, Japan

[73] Assignee: Akamatsu ForsysCo., Ltd., Osaka, Japan

[21] Appl. No.: 08/977,085

[22] Filed: Nov. 24, 1997

[30] Foreign Application Priority Data

Nov. 25, 1996 [JP] Japan ..... 8-313163

[51] Int. Cl.[6] ..... B21J 13/02

[52] U.S. Cl. ..... 72/478; 72/352

[58] Field of Search ..... 72/478, 467, 468, 72/352, 354.2, 358; 470/191; 29/446

[56] References Cited

U.S. PATENT DOCUMENTS

| | | | |
|---|---|---|---|
| 567,606 | 9/1896 | McCool et al. | 72/468 |
| 3,823,598 | 7/1974 | Freman | 72/467 |
| 4,095,449 | 6/1978 | Roach et al. | 72/273 |
| 4,222,260 | 9/1980 | McDermott | 72/345 |
| 4,417,464 | 11/1983 | Tosa | 72/478 |
| 4,574,607 | 3/1986 | Akino et al. | 72/112 |
| 4,982,596 | 1/1991 | Peterson et al. | 72/467 |
| 4,984,445 | 1/1991 | Ohuchi et al. | 72/360 |

FOREIGN PATENT DOCUMENTS

| | | | |
|---|---|---|---|
| 197707 | 7/1977 | Russian Federation | 72/468 |

*Primary Examiner*—Joseph J. Hail, III
*Assistant Examiner*—Susan R. Kingsbury
*Attorney, Agent, or Firm*—Arnold B. Silverman; Benjiamin T. Queen, II; Eckert Seamans Cherin & Mellott, LLC

[57] ABSTRACT

A forging or cold-pressing tool comprising an annular combination of nib pieces held in a case and having a regular polygonal die bore inside the nib pieces, each of the nib pieces having an approximately isosceles trapezoidal cross section. Opposite ends of each nib piece before assembly make an angle α smaller than an angle obtained by dividing 360° by the number of nib pieces. When held in the case, the nib pieces are elastically deformed by a tightening force of the case, whereby the butting end faces of each pair of adjacent nib pieces are entirely pressed into contact with each other under a pressure increasing from portion to portion toward the die bore. A layer for giving improved resistance to seizure is formed over the surface of each nib piece.

4 Claims, 7 Drawing Sheets

FORGING OR COLD-PRESSING TOOL AND METHOD OF ASSEMBLING SAME

FIELD OF THE INVENTION

The present invention relates to forging or cold-pressing tools such as dies comprising a combination of approximately isosceles trapezoidal nib pieces and having a regular polygonal die bore, and a method of assembling the tool.

BACKGROUND OF THE INVENTION

FIG. 14 shows such a forging or cold-pressing tool already known (see JP-B-62342/1990 and corresponding U.S. Pat. No. 4,417,464). The tool is a die comprising a nib 2 formed by six nib pieces 3 isosceles trapezoidal in cross section and arranged in an annular form in combination, and a case 1 having the nib 2 inserted therein. A regular hexagonal die bore 4 is formed by the nib pieces 3 inside thereof. The tool is used mainly for manufacturing bolts or nuts. A blank (not shown) is inserted into the die bore 4 and pressed to a specified shape by the tool around the blank.

However, it is likely that the material of the blank will bite in between the butting ends of the adjacent nib pieces 3, 3 to create a clearance therebetween by being pressed within the die bore 4. The clearance, once produced, permits the blank material to wedge in more readily, enlarging the clearance between the nib pieces 3, 3 at an accelerated rate.

When the clearance between the nib pieces 3, 3 is enlarged, the portion of blank material wedging into the clearance remains on the pressed product as a burr to make the product faulty. The tool then needs to be replaced by a new one.

SUMMARY OF THE INVENTION

An object of the present invention is to provide a tool wherein the material of the blank is prevented from biting in between the butting ends of nib pieces to give an extended life to the tool.

The present invention provides a forging or cold-pressing tool which comprises a combination of nib pieces 3 arranged in an annular form and each having an approximately isosceles trapezoidal cross section and slanting end faces 31, 31 as shown, for example, in FIG. 1, and a case 1 having the nib pieces 3 held therein, the nib pieces 3 defining a regular polygonal die bore 4 inside thereof. Before assembly, the end faces 31 of each nib piece 3 make an angle $\alpha$ which is smaller than an angle obtained by dividing 360° by the number of nib pieces 3. The nib pieces 3 as held in the case 1 are elastically deformed by a tightening force of the case 1, whereby the slanting end faces 31, 31 of each pair of adjacent nib pieces 3, 3 are entirely pressed into contact with each other with a pressure increasing from portion to portion toward the die bore 4.

The forging or cold-pressing tool of the invention is produced first by preparing a plurality of nib pieces 3 each having an approximately isosceles trapezoidal cross section and slanting faces 31, 31 at respective opposite ends thereof. The end faces 31, 31 of each nib piece 3 make an angle $\alpha$ which is smaller than an angle obtained by dividing 360° by the number of nib pieces 3. The nib pieces 3 are arranged in an annular form with their shorter sides positioned inside, and then pressed from outside and thereby elastically deformed, whereby the butting end faces 31, 31 of each pair of adjacent nib pieces 3, 3 are entirely pressed into contact with each other. In this state, the nib pieces 3 are held in a case 1 directly or as inserted in a sleeve.

The pressure acting between the butting end faces of each pair of adjacent nib pieces 3, 3 is greater toward the bore 4. Accordingly, even if the blank is pressed within the die bore 4 in such a direction that the outer periphery thereof is enlarged, the butting end faces of the adjacent nib pieces 3, 3 are prevented from forming therebetween a clearance which would permit the material of the blank to bite in. Consequently, the blank is precluded from biting in between the butting end faces and developing a burr, whereby the tool can be assured of a lengthened life.

DETAILED DESCRIPTION OF THE PREFERRED EMBODIMENTS

First Embodiment

An embodiment of the invention will be described below with reference to the drawings concerned.

Figure 1:
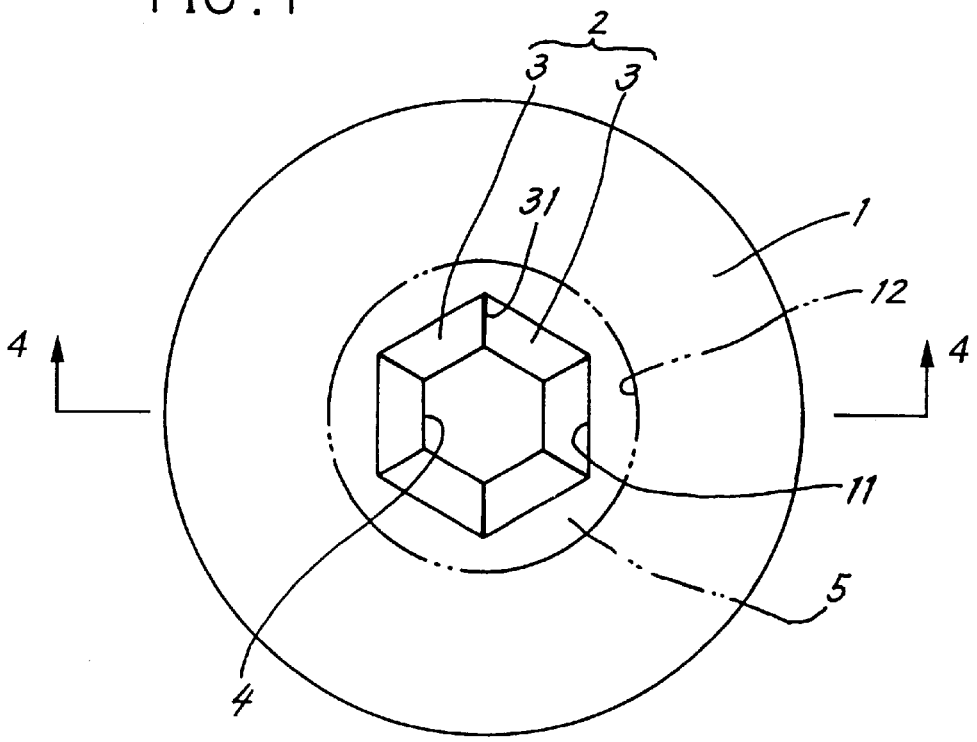
FIG. 1 is a plan view of a die.
Figure 4:
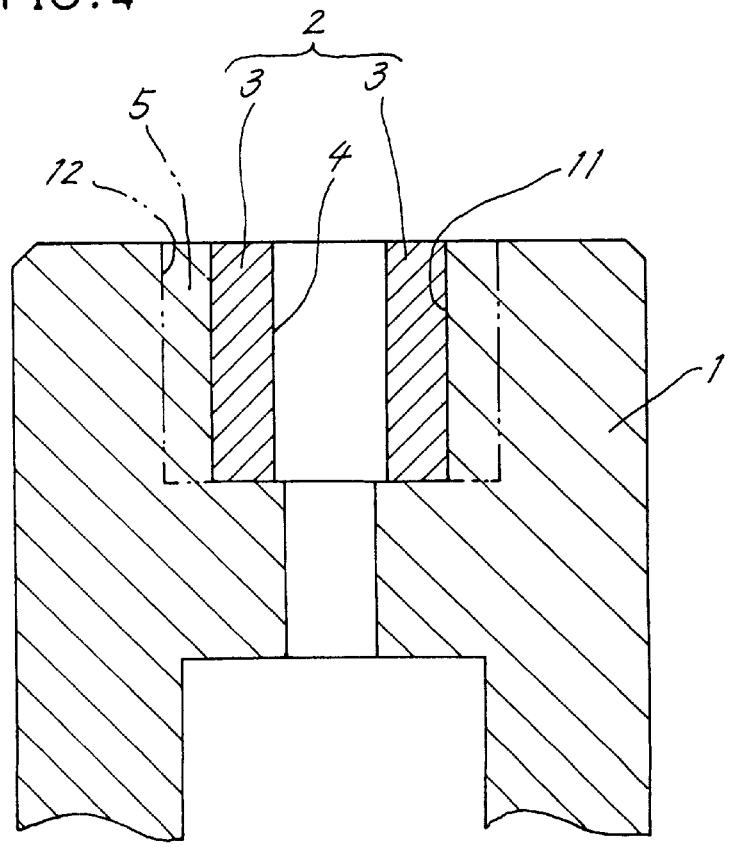
FIG. 4 is a view in section taken along the line A—A in FIG. 1.

FIG. 1 is a plan view showing a forging or cold-pressing tool, more specifically, a die for forming a hexagon nut by forging or cold pressing, and FIG. 4 is a side elevation in section taken along the line A—A in FIG. 1.

As is already known, the die comprises a case 1 formed with a hexagonal nib socket 11 in one end coaxially therewith, and a nib 2 held in the case 1 by a press fit or shrink fit.

The nib 2 comprises six nib pieces 3 made of cemented carbide and having an isosceles trapezoidal cross section. The nib pieces 3 are arranged in an annular form, each with the shorter side thereof positioned inside.

Figure 2:
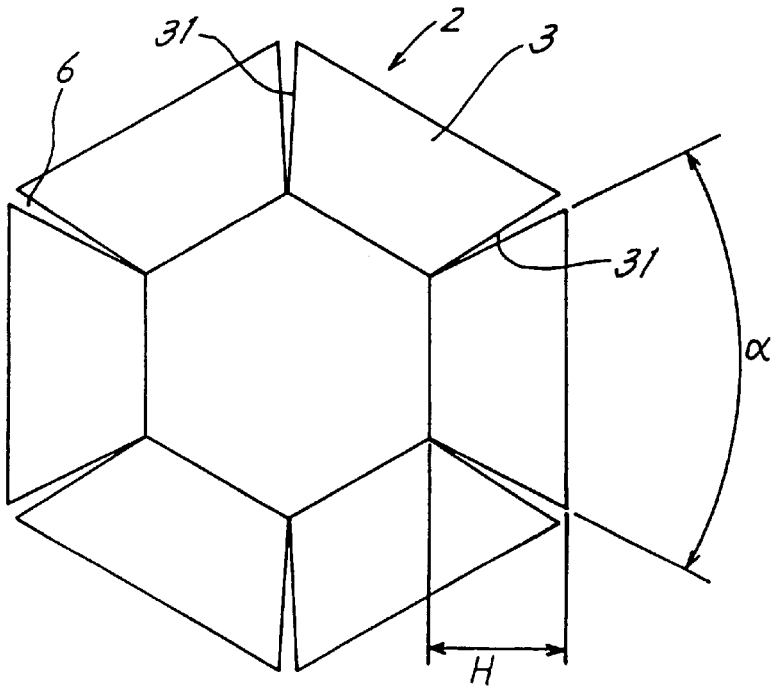
FIG. 2 is a plan view of a nib comprising nib pieces as arranged before being fitted into a case.

Before the nib pieces 3 are fitted into the case 1, each nib piece 3 has opposite end faces 31, 31 which are slanted as seen in FIG. 2, and the end faces 31, 31 make an angle $\alpha$ which is slightly smaller than 60°. When the nib pieces 3 are arranged annularly with the shorter sides thereof positioned inside and with the opposed inside edges of each pair of adjacent nib pieces 3, 3 in contact with each other, an outwardly enlarging clearance 6 is created between the pair of nib pieces 3, 3 as shown in FIG. 2.

The nib pieces 3 in the state of FIG. 2 are pressed from outside, whereby the butting end faces 31, 31 of each pair of adjacent nib pieces 3, 3 are elastically deformed and pressed into contact with each other over the entire areas thereof. In this state, the case 1 is caused to hold the nib pieces 3 in its nib socket 11. With the nib pieces 3 held in the case 1 as shown in FIG. 1, no clearance occurs between the butting end faces 31, 31 of each pair of adjacent nib pieces 3, 3.

The angle α formed by the end faces 31, 31 of each nib piece 3 is suitable insofar as the entire end faces 31, 31 of each pair of adjacent nib pieces 3, 3 can be pressed into contact with each other by the elastic deformation of the nib pieces 3. The angle can be determined optimally by calculation as by the finite element method, with consideration given, for example, to the interference involved in the insertion of the nib 2 in the cavity 11, the thickness H of the nib piece 3 between its long side and short side and the material of the nib piece 3.

According to the present embodiment, the angle α is 59°50', while this angle can be at least 59°30' to less than 60°.

The case 1 can be caused to hold therein the nib 2 comprising the combination of six nib pieces 3 and as fitted in a sleeve 5 as indicated in a broken line in FIG. 1. In this case, the sleeve 5 has a regular hexagonal nib socket 11 for holding the nib 2 elastically deformed with the butting end faces 31, 31 of each pair of adjacent nib pieces 3, 3 entirely in pressing contact with each other, and is circular in outer periphery. The case 1 is then formed with a circular sleeve socket 12 for inserting therein the sleeve 5 by a press fit or shrink fit.

Figure 3:
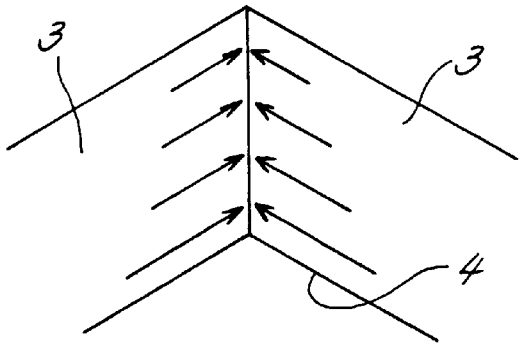
FIG. 3 is a view for illustrating internal stress in adjacent nib pieces in pressing contact with each other.

The pressure acting between the abutting end faces 31, 31 of the adjacent nib pieces 3, 3 according to the embodiment is indicated by arrows of varying lengths in FIG. 3. It is seen that the pressure increases from portion to portion toward the die bore 4. Accordingly, even if the blank is pressed within the die bore 4 in such a direction that the outer periphery thereof is enlarged, the butting end faces of the adjacent nib pieces 3, 3 are prevented from forming therebetween a clearance which would permit the material of the blank to bite in. Consequently, the blank is precluded from biting in between the butting end faces and developing a burr, whereby the tool can be assured of a lengthened life.

At least one of the entire inner surface of the nib socket 11 and the surface of each nib piece 3 may be coated with a modification layer having resistance to seizure, such as a TiC or TiCN layer formed by chemical vapor deposition (CVD) or TiN layer formed by physical vapor deposition (PVD). Since the nib pieces 3 elastically deform when press-fitted into the case 1 as previously stated, an extremely great frictional force acts between the inner surface of the nib socket 11 and the nib pieces 3, as well as between the adjacent nib pieces 3, 3. However, if the seizure-resistant modification layer is formed over the surface of the nib socket 11 and/or the surfaces of the nib pieces 3, an enhanced effect is available to prevent the seizure of the nib pieces 3 to the case 1.

Second Embodiment

Figure 5:
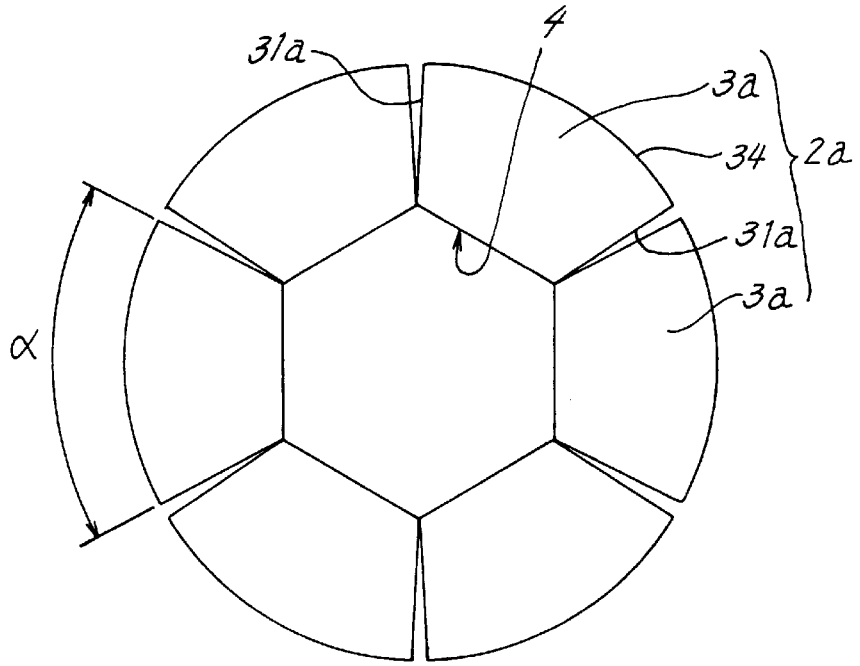
FIG. 5 is a plan view of another embodiment of nib formed with a hexagonal die bore.

FIG. 5 shows another embodiment, i.e., a nib 2*a* having a circular outer periphery and comprising six nib pieces 3*a*. The nib 2*a* is shown before it is held in a case.

Each of the nib pieces 3*a* resembles an isosceles trapezoid in shape but differs therefrom in that the nib piece 3*a* has an outer side 34 opposite to a die bore 4 and shaped in a circular-arc form.

Opposite end faces 31*a*, 31*a* of the nib piece 3*a* make an angle α which is not smaller than 59°30' to less than 60° as in the above embodiment.

When the nib 2*a* is held tightened up in a circular nib socket of the case, the clearance between each pair of adjacent nib pieces 3*a*, 3*a* is eliminated by the elastic deformation of the nib pieces 3*a*. This produces the same effect as previously described.

Third Embodiment

Figure 6:
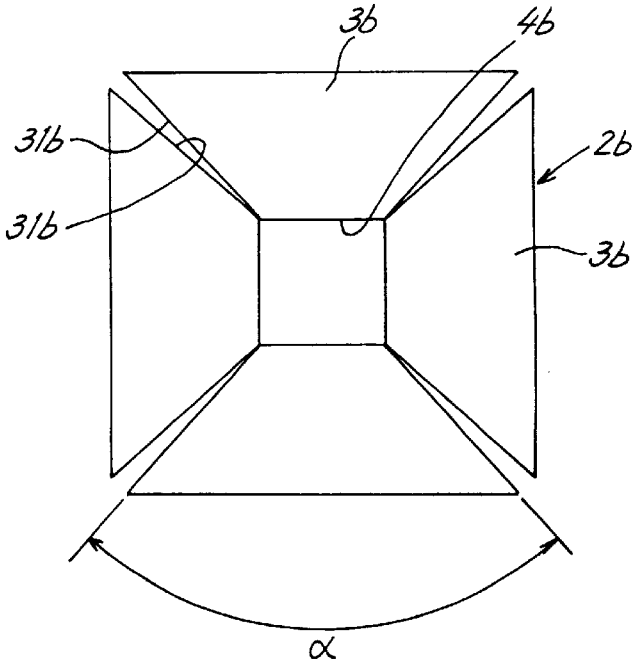
FIG. 6 is a plan view of a nib formed with a square die bore.

FIG. 6 shows another embodiment, in which four isosceles trapezoidal nib pieces 3*b* are combined to define a square die bore 4*b*.

Opposite end faces 31*b*, 31*b* of the nib piece 3*b* make an angle α which is not smaller than 89°30' to less than 90°.

When the four nib pieces 3*b* are held tightened up in a square nib socket of a case, the clearance between each pair of adjacent nib pieces 3*b*, 3*b* is eliminated by the elastic deformation of the nib pieces 3*b*. This produces the same effect as previously described.

Fourth Embodiment

Figure 7:
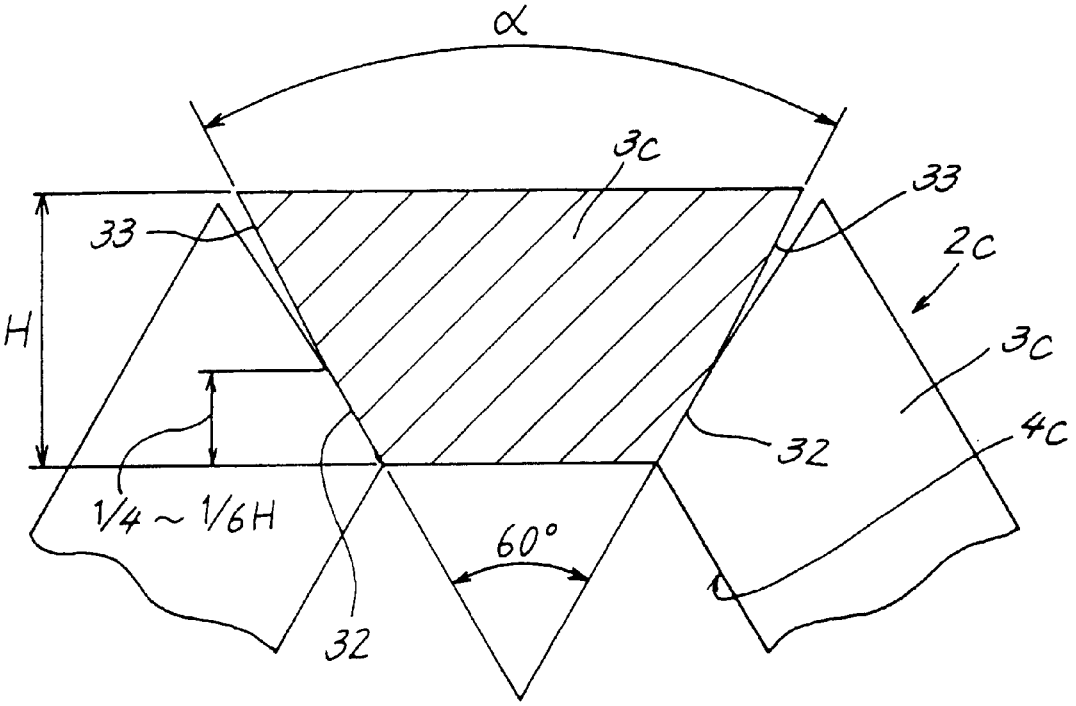
FIG. 7 is a plan view of another embodiment of nib formed with a hexagonal die bore.

FIG. 7 shows another embodiment, i.e., a nib 2*c* which comprises six nib pieces 3*c* defining a hexagonal die bore 4*c*.

Before assembly, each of the nib pieces 3*c* has at each end thereof two faces 32 and 33 toward the short side and toward the long side, respectively. The faces 32, 32 of the nib piece 3*c* toward the short side thereof form an angle of 60°, while the faces 33, 33 toward the long side form an angle which is different from this angle and is not smaller than 59°30' to less than 60°.

Based on the distance H between the parallel sides of the nib piece 3*c*, the corresponding distance of the portion having faces 32, 32 making the angle of 60° is preferably ¼ to ⅙H.

The six nib pieces 3*c* are arranged in an annular form, with the short sides thereof positioned inside and with the bore-side end faces of each pair of adjacent nib pieces 3*c*, 3*c* entirely in contact with each other, and the arrangement of the nib pieces 3*c* is pressed from outside and thereby elastically deformed to press the whole end faces of the adjacent nib pieces 3*c*, 3*c* into contact with each other over the entire areas thereof. A case 1 is caused to hold the nib prices 3*c* in this state, directly or as fitted in a sleeve.

The bore-side end faces 32, 32 of each nib piece 3*c* form an angle of 60°, so that when the nib pieces 3*c* are arranged annularly before being fitted into the case 1, the bore-side faces 32, 32 of the adjacent nib pieces 3*c* can be brought into face-to-face contact with each other. Consequently, the arrangement of nib pieces 3*c* can be pressed from outside with the nib pieces 3*c* prevented from shifting relative to one another without the necessity of using a special jig, and can therefore be fitted into the case 1 easily.

The embodiment of FIG. 7 can of course be applied to the case wherein four nib pieces 3*b* are assembled into a nib 2*b* as shown in FIG. 6.

Fifth Embodiment

Figure 8:
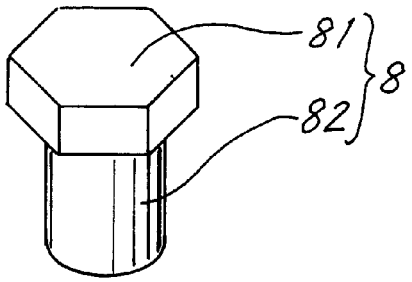
FIG. 8 is a perspective view of a shaped part having a hexagon head like a bolt.

This embodiment is a forging or cold-pressing tool for producing a shaped part such as a bolt having a hexagon head 81 and a shank 82 extending therefrom as shown in FIG. 8. This embodiment has the same feature as the foregoing embodiments in that butting end faces of each pair of adjacent nib pieces 3, 3 are prevented from forming therebetween a clearance permitting the material of the blank to bite in.

Figure 9:
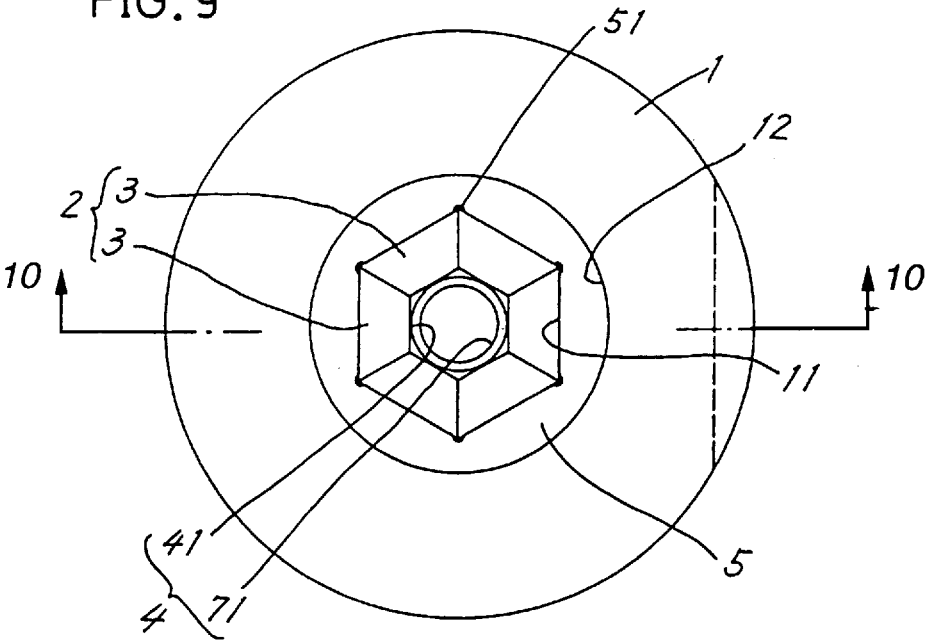
FIG. 9 is a plan view of a die for forming the part of FIG. 8.
Figure 10:
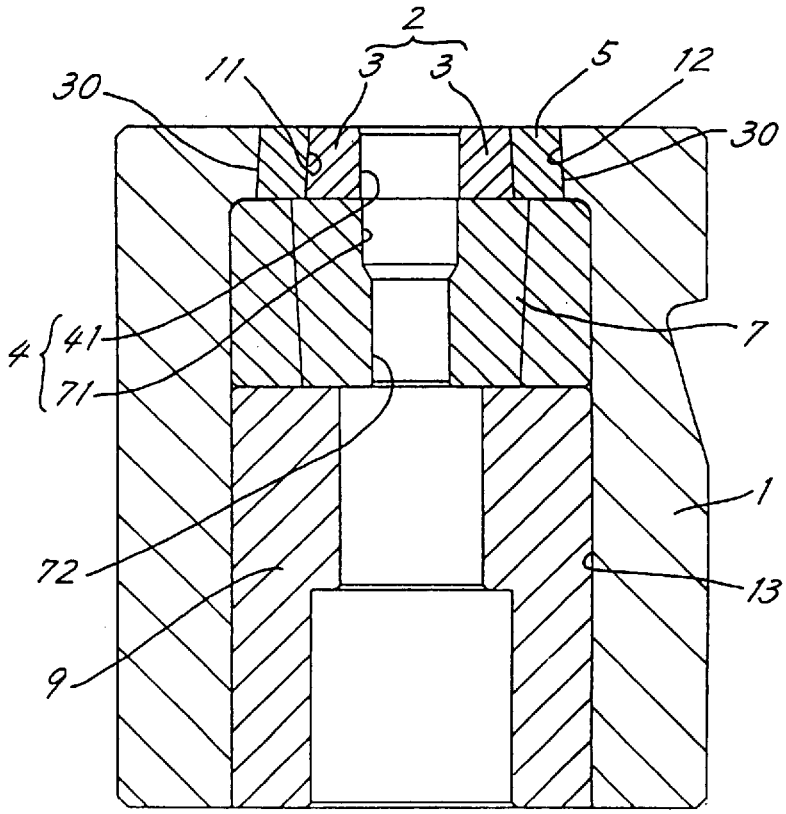
FIG. 10 is a side elevation in section taken along the line B—B in FIG. 9 and showing the die.

FIG. 9 is a plan view of the tool of this embodiment, and FIG. 10 is a side elevation in section taken along the line B—B in FIG. 9. Coaxially formed in a case 1 are a bore 12 tapered toward a front end thereof and providing an opening at this end, and a straight bore 13 communicating with the tapered bore 12 and providing an opening at a rear end of the case 1.

The case 1 has a sleeve 5 fitting in the tapered bore 12, and a nib support 7 and a pushing-up member 9 which are fitted in the straight bore 13. The nib support 7 is positioned on the upper side of the pushing-up member 9. The sleeve 5 is formed on its axis with a tapered nib socket 11 regular hexagonal and having a nib 2 press-fitted therein. The sleeve 5 is formed at each corner of its nib socket 11 with a round recess 51 for stress relief (see FIG. 9).

The nib 2 comprises six nib pieces 3 of cemented carbide having an isosceles trapezoidal cross section and arranged in an annular form with their short sides positioned inside. The nib 2 centrally has an upper die portion 41 in the form of a hexagonal bore in conformity with the shape of the hexagon head 81 of the shaped part 8.

The longer side, i.e., the shorter side, of the nib piece 3 is in the form of a tapered surface 30 conforming to the tapered nib socket 11 of the sleeve 5. The nib support 7 is centrally formed with a lower die portion 71 in conformity with the shank 82 of the shaped part 8. The nib support 7 has a knockout pin guide bore 72 coaxial therewith and communicating with the lower die portion 71.

The upper die portion 41 of the nib 2 and the lower die portion 71 of the nib support 7 provide a die bore 4 shaped in conformity with the shape of the part 8. When a blank is inserted into the upper die portion 41 and the lower die portion 71 and pressed from therearound, a shaped part 8 is produced.

Before the nib pieces 3 are fitted into the case 1, the slanting end faces 31, 31 of each nib piece 3 make an angle $\alpha$ which is slightly smaller than 60° also in this embodiment as shown in FIG. 2.

The nib pieces 3 in the state of FIG. 2 are pressed from outside to elastically deform each pair of adjacent nib pieces 3, 3 and press the opposed slanting end faces 31, 31 thereof into contact with each other over the entire areas thereof.

In this state, the sleeve 5 is caused to hold the nib pieces 3 in its nib socket 11. With the nib pieces 3 held in the sleeve 5, no clearance occurs between the butting slanting end faces 31, 31 of each pair of adjacent nit pieces 3, 3, whereby the material of the blank can be prevented from biting in between the butting end faces of the nib pieces 3, 3 to preclude formation of a burr.

A seizure-resistant modification layer may be formed by CVD or PVD on the entire surfaces of the nib pieces 3, the surface of the case 1 defining the tapered bore 12 and the surface of the sleeve 5 defining the nib socket 11 as in the embodiment described.

The nib may have a circular outer periphery provided by the nib pieces 2*a* shown in FIG. 5. Further as shown in FIG. 7, six nib pieces 3*c* may be used to define a hexagonal die bore 4*c*, such that based on the distance H between the parallel sides of each nib piece 3*c*, the corresponding distance of the portion forming an angle of 60° is ¼ to ⅙H. Further for producing parts having a square head, four isosceles trapezoidal nib pieces 3*b* may be combined to provide a square upper die portion 4*b* as shown in FIG. 6. When such nib pieces are in any of these arrangements and held as tightened up in the nib socket 11 of the sleeve 5, the clearance between the adjacent nib pieces is eliminated by the elastic deformation of the nib pieces, whereby the same effect as described above can be obtained.

Sixth Embodiment

Figure 11:
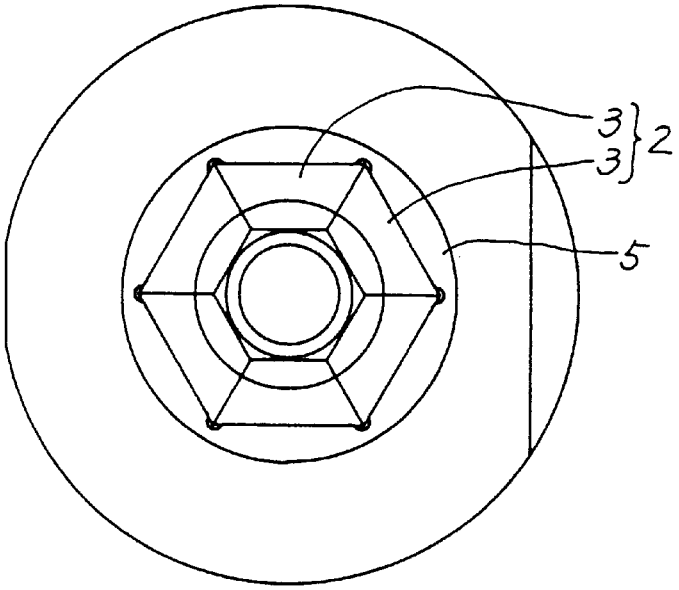
FIG. 11 is a plan view of a die for forming the flanged nut shown in FIG. 13.
Figure 12:
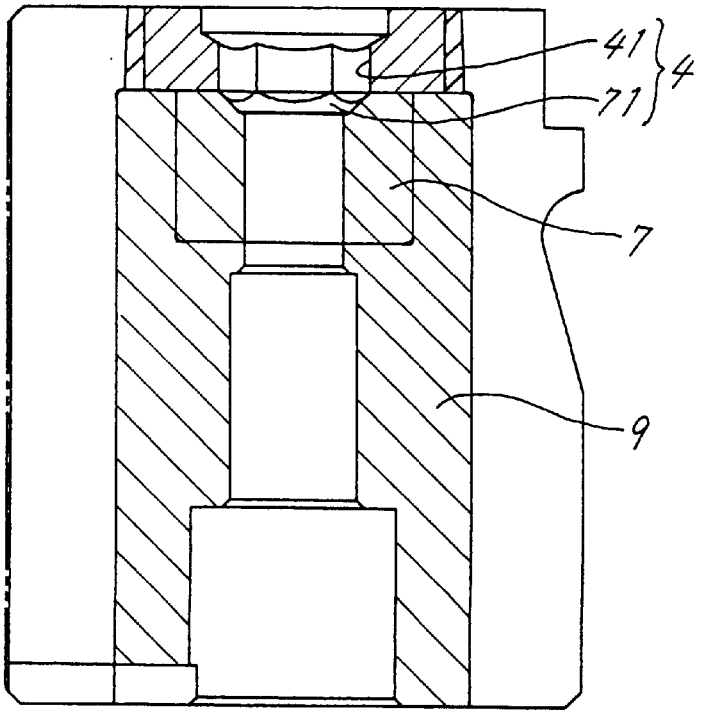
FIG. 12 is a side elevation in section of the die shown in FIG. 11.
Figure 13:
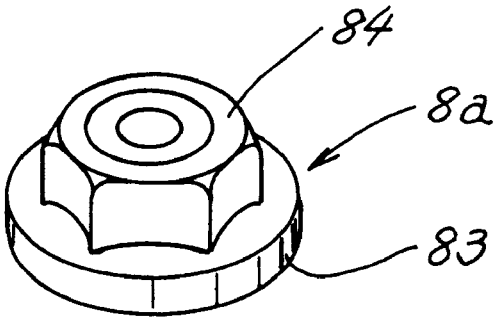
FIG. 13 is a perspective view of the flanged nut.
Figure 14:
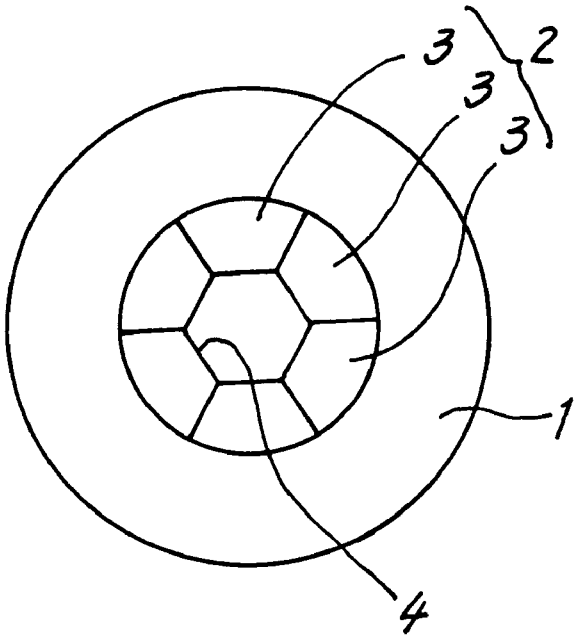
FIG.14 PRIOR ART
FIG. 14 is a plan view of a conventional die.

FIGS. 11 and 12 are a plan view and a view in vertical section of a die for producing the cold-pressed nut 8*a* having a flange and shown in FIG. 13. The nut 8*a* comprises a flange 83 in the form of a disk, and a nut portion 84 provided on the flange 83 and having a smaller diameter than the flange 83.

The die has inside thereof a nib 2 comprising six nib pieces 3 inserted in a sleeve 5 by a press fit. The nib 2 is formed with an upper die portion 41 for forming a hexagonal portion and the flange 83 on a blank, and a nib support 7 is formed with a lower die portion 71 corresponding to the nut portion 84.

The combination of nib pieces 3 is the same as already described with reference to FIGS. 3 and 4, and will therefore not be described again.

The present invention is not limited to the dies of the embodiments but can be embodied generally as forging or cold-pressing tools having split nibs, such as forging or cold-pressing punches and dies for trimming bolt heads to a polygonal form.

What is claimed is:

1. A forging or cold-pressing tool comprising a plurality of nib pieces arranged in an annular form in combination, each of the nib pieces having an approximately isosceles trapezoidal cross section, slanting faces at respective opposite ends thereof and a shorter side positioned inwardly of the annular arrangement, and a case having the nib pieces held therein to define a regular polygonal die bore by the nib pieces inside thereof and being used to press a blank, the tool being characterized in that the opposite ends of each nib piece before assembly make an angle $\alpha$ smaller than an angle obtained by dividing 360° by the number of nib pieces, an outwardly enlarging clearance being created between the pair of nib pieces which are arranged annularly with the shorter sides thereof positioned inside, the nib pieces being elastically deformed by a tightening force of the case when held in the case, whereby the abutting end faces of each pair of adjacent nib pieces are entirely pressed into contact with each other under a pressure increasing from an outer end portion to a portion toward the die bore, and the abutting end faces of the adjacent nib pieces resisting forming therebetween a clearance which would permit the material of the blank to enter between the adjacent contacting nibs.

2. A forging or cold-pressing tool according to claim 1 wherein the case is provided inside thereof with a nib support for supporting thereon the nib pieces arranged in the annular form, and a nib socket having the nib pieces inserted therein by a press fit, and the die bore for inserting a blank therein comprises an upper die portion formed in the center of the nib pieces fitted in the nib socket, and a lower die portion formed in the nib support.

3. A forging or cold-pressing tool according to claim 2 wherein at least one of the nib socket and each nib piece is formed over a surface thereof with a modification layer having resistance to seizure.

4. A forging or cold-pressing tool according to claim 1 wherein at least one of an inner surface of the case and an outer surface of each nib piece is formed with a modification layer having resistance to seizure.

* * * * *

UNITED STATES PATENT AND TRADEMARK OFFICE

CERTIFICATE OF CORRECTION

PATENT NO. : 5,956,993

DATED : September 28, 1999

INVENTOR(S) : Ken-ichi Akamatsu

It is certified that errors appear in the above-identified patent and that said Letters Patent should be corrected as shown below:

Col. 2, line 19, "A-A" should read -- 4-4 --.

Col. 2, line 33 "B-B" should read -- 10-10 --.

Col. 4, line 48, correct "prices" to read -- pieces --.

Col. 5, line 7, "B-B" should read -- 10-10 --.

Col. 5, line 49, correct "nit" to read – nib --.

Signed and Sealed this

Twenty-third Day of January, 2001

*Attest:*

*Attesting Officer*

Q. TODD DICKINSON

*Commissioner of Patents and Trademarks*